US011670444B2

(12) United States Patent
Dai et al.

(10) Patent No.: US 11,670,444 B2
(45) Date of Patent: Jun. 6, 2023

(54) INTEGRATED MAGNETIC ASSEMBLIES AND METHODS OF ASSEMBLING SAME

(71) Applicant: ABB Power Electronics Inc., Plano, TX (US)

(72) Inventors: Ke Dai, Shanghai (CN); Tom Sun, Shanghai (CN); Lanlan Yin, Shanghai (CN)

(73) Assignee: ABB Power Electronics Inc., Plano, TX (US)

( * ) Notice: Subject to any disclaimer, the term of this patent is extended or adjusted under 35 U.S.C. 154(b) by 637 days.

(21) Appl. No.: 16/432,484

(22) Filed: Jun. 5, 2019

(65) Prior Publication Data

US 2019/0371512 A1 Dec. 5, 2019

(30) Foreign Application Priority Data

Jun. 5, 2018 (CN) ..... 201810569143.2

(51) Int. Cl.

| | |
|---|---|
| ***H01F 27/24*** | (2006.01) |
| ***H01F 41/02*** | (2006.01) |
| ***H01F 3/14*** | (2006.01) |
| ***H01F 27/28*** | (2006.01) |

(52) U.S. Cl.

CPC ..... *H01F 27/24* (2013.01); *H01F 3/14* (2013.01); *H01F 27/2804* (2013.01); *H01F 41/0206* (2013.01)

(58) Field of Classification Search

CPC ..... H01F 27/24; H01F 3/14; H01F 27/2804; H01F 41/0206; H01F 27/263; H01F 27/255; H01F 27/2847; H01F 27/28; H01F 38/14; H02M 1/00

See application file for complete search history.

(56) References Cited

U.S. PATENT DOCUMENTS

| | | | | |
|---|---|---|---|---|
| 5,506,560 | A * | 4/1996 | Takeuchi | H01F 27/255 336/83 |
| 11,087,914 | B2 * | 8/2021 | Yokoyama | H01F 27/24 |
| 2004/0080978 | A1 * | 4/2004 | Jitaru | H01F 27/36 365/173 |
| 2004/0108929 | A1 * | 6/2004 | Ichikawa | H01F 27/2823 336/83 |

(Continued)

FOREIGN PATENT DOCUMENTS

EP 388930 A * 9/1990

*Primary Examiner* — Mang Tin Bik Lian

(74) *Attorney, Agent, or Firm* — Armstrong Teasdale LLP

(57) ABSTRACT

An integrated magnetic assembly includes a magnetic core having a first component and a second component. The first component includes a first face and a winding leg extending from the first face. The winding leg includes a top face spaced from and oriented generally parallel to the first face. The second component is coupled to the first component and has a second face facing the first face. The second component further includes a third face recessed from and oriented generally parallel to the second face and a recess sidewall extending between the second face and the third face. The integrated magnetic assembly further includes an input winding and an output winding each inductively coupled to the magnetic core. The third face and the recess sidewall define a recess within the second face. Additionally, a gap is defined between the top face and the third face.

19 Claims, 11 Drawing Sheets

(56) References Cited

U.S. PATENT DOCUMENTS

| | | | | |
|---|---|---|---|---|
| 2013/0207767 | A1* | 8/2013 | Worthington | H01F 27/363<br>336/84 C |
| 2014/0300440 | A1* | 10/2014 | Koenig | H01F 3/14<br>29/605 |
| 2016/0141088 | A1* | 5/2016 | Dai | H01F 27/346<br>336/178 |
| 2017/0221625 | A1* | 8/2017 | Sullivan | H01F 27/24 |
| 2021/0005377 | A1* | 1/2021 | Suzuki | H01F 41/042 |

* cited by examiner

INTEGRATED MAGNETIC ASSEMBLIES AND METHODS OF ASSEMBLING SAME

CROSS-REFERENCE TO RELATED APPLICATIONS

This application claims priority to Chinese Patent Application No. 201810569143.2, filed on Jun. 5, 2018, the entire disclosure of which is incorporated by reference herein.

TECHNICAL FIELD

The present disclosure relates generally to power electronics and, more particularly, to integrated magnetic assemblies for use in power electronics.

BACKGROUND

High density power electronic circuits often require the use of multiple magnetic electrical components for a variety of purposes, including energy storage, signal isolation, signal filtering, energy transfer, and power splitting. In particular, these magnetic electrical components often include an air gap located along a flux path of the magnetic electrical components.

However, in at least some known integrated magnetic assemblies, the magnetic flux produced by one component may not result in a zero net effect on the operation of the other component(s) in the integrated structure. As a result, the effectiveness and/or the efficiency of the integrated components may be reduced.

Additionally, in at least some known integrated magnetic assemblies, fringing flux may have several detrimental effects on the operation of the integrated magnetic assembly. Fringing flux is a component of a magnetic flux that deviates from a main magnetic flux path. Fringing flux often passes through other, non-active components in an electronic circuit, inducing eddy currents in the windings of such components. This results in increased power losses in the windings and reduced efficiency. In particular, fringing flux which passes vertically through winding layers of such components results in especially large power losses in the windings. In addition, fringing flux reduces the inductance of integrated magnetic assemblies. Thus, when such integrated magnetic assemblies are used in power converters, fringing flux increases the amplitude of ripple current, leading to higher power losses and reduced efficiency.

SUMMARY

In one aspect, an integrated magnetic assembly is provided. The integrated magnetic assembly includes a magnetic core having a first component and a second component. The first component includes a first face and a winding leg extending from the first face. The winding leg includes a top face spaced from and oriented generally parallel to the first face. The second component is coupled to the first component and has a second face facing the first face. The second component further includes a third face recessed from and oriented generally parallel to the second face and a recess sidewall extending between the second face and the third face. The integrated magnetic assembly further includes an input winding and an output winding each inductively coupled to the magnetic core. The third face and the recess sidewall define a recess within the second face. Additionally, a gap is defined between the top face and the third face.

In another aspect, a magnetic core for an integrated magnetic assembly is provided. The magnetic core includes a first component comprising a first face and a winding leg extending from the first face, the winding leg includes a top face spaced from and oriented generally parallel to the first face. The magnetic core further includes a second component coupled to the first component. The second component has a second face facing the first face. The second component further includes a third face recessed from and oriented generally parallel to the second face and a recess sidewall extending between the second face and the third face. The third face and the recess sidewall define a recess within the second face. Additionally, a gap is defined between the top face and the third face.

In yet another aspect, a method of assembling an integrated magnetic assembly is provided. The method includes providing a first component including a first face and a winding leg extending from the first face. The winding leg has a top face spaced from and oriented generally parallel to the first face. The method further includes inductively coupling an input winding to the first component such that the input winding is wound around the winding leg. The method further includes inductively coupling an output winding to the first component such that the output winding is wound around the winding leg. The method further includes coupling a second component to the first component. The second component includes a second face and a third face recessed from and oriented generally parallel to the second face. The second component also has a recess sidewall extending between the second face and the third face. The third face and the recess sidewall define a recess within the second face.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements. The detailed description particularly refers to the accompanying figures in which.

DETAILED DESCRIPTION OF THE DRAWINGS

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

"Generally parallel", as used herein throughout the specification and claims, means being oriented within ten degrees or less of parallel. For example, a first surface oriented generally parallel to a second surface means that the first surface has an orientation that is within ten degrees or less of being parallel to the orientation of the second surface.

"Generally perpendicular", as used herein throughout the specification and claims, means being oriented within ten degrees or less of perpendicular. For example, a first surface oriented generally perpendicular to a second surface means that the first surface has an orientation that is within ten degrees or less of being perpendicular to the orientation of the second surface.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

An integrated magnetic assembly includes a magnetic core having a first component and a second component. The first component includes a first face and a winding leg extending from the first face. The winding leg includes a top face spaced from and oriented generally parallel to the first face. The second component is coupled to the first component and has a second face facing the first face. The second component further includes a third face recessed from and oriented generally parallel to the second face and a recess sidewall extending between the second face and the third face. The integrated magnetic assembly further includes an input winding and an output winding each inductively coupled to the magnetic core. The third face and the recess sidewall define a recess within the second face. Additionally, a gap is defined between the top face and the third face.

Figure 1:
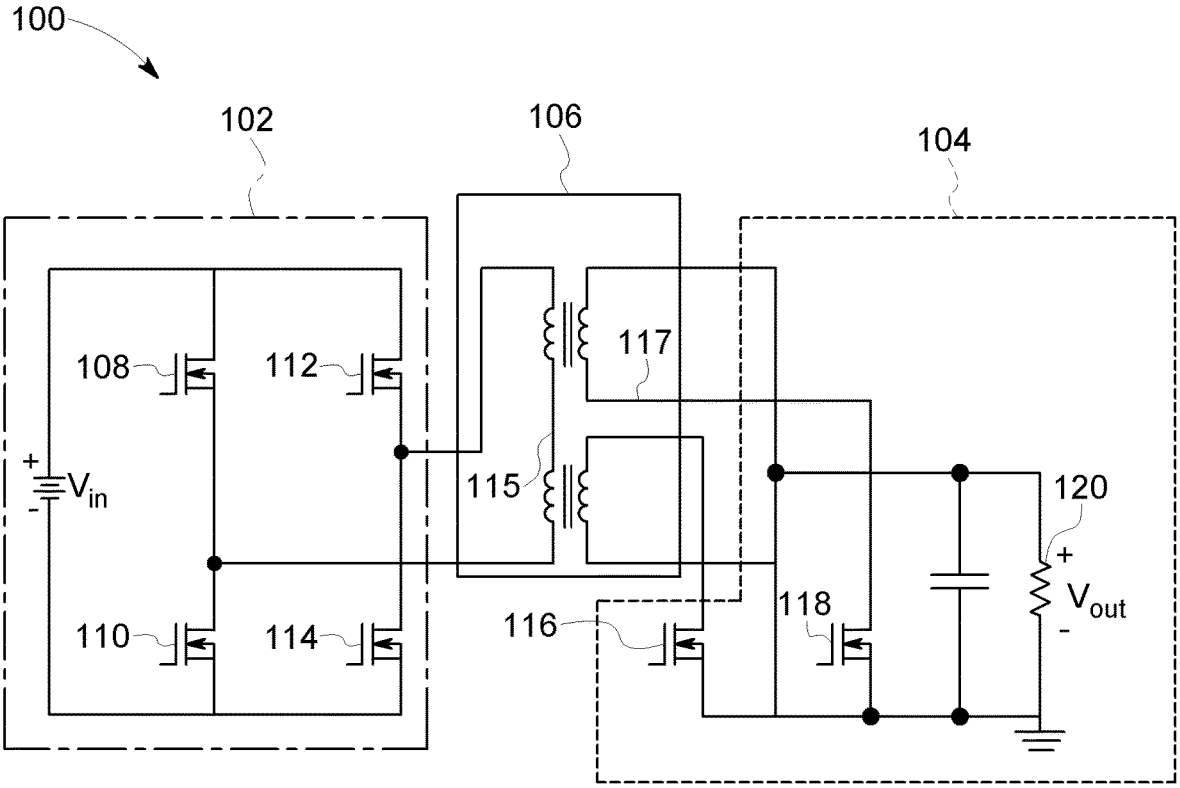
FIG. 1 is a schematic view of an exemplary power converter including an integrated magnetic assembly.

FIG. 1 is a schematic view of an exemplary electronic circuit, shown in the form of a power converter 100 configured to convert an input voltage $V_{in}$ to an output voltage $V_{out}$. Power converter 100 includes an input side 102 and an output side 104 electrically coupled to one another via an integrated magnetic assembly 106.

Input side 102 includes a first switching device 108, a second switching device 110, a third switching device 112, and a fourth switching device 114. An input winding 115 of integrated magnetic assembly 106 is electrically coupled between first switching device 108 and second switching device 110, and between third switching device 112 and fourth switching device 114.

Output side 104 includes a fifth switching device 116 and a sixth switching device 118. An output winding 117 of integrated magnetic assembly 106 is electrically coupled to fifth switching device 116 and sixth switching device 118, respectively.

In operation, first switching device 108 and fourth switching device 114 are jointly switched between opened and closed positions, and second switching device 110 and third switching device 112 are jointly switched between opened and closed positions in opposite phases with respect to first switching device 108 and fourth switching device 114. Similarly, fifth switching device 116 and sixth switching device 118 are switched between opened and closed positions in opposite phases to produce output voltage Vout, which is supplied to a load 120. In the exemplary embodiment, switching devices 108, 110, 112, 114, 116, and 118 are transistor switches (specifically, MOSFETs), and are coupled to one or more controllers (not shown) configured to output a pulse-width modulated control signal to the gate side of each switching device 108, 110, 112, 114, 116, and 118 to switch switching devices 108, 110, 112, 114, 116, and 118 between open and closed positions. Alternatively, switching devices 108, 110, 112, 114, 116, and 118 may be any switching device that enables power converter 100 to function as described herein.

While integrated magnetic assembly 106 is described herein with reference to power converter 100, integrated magnetic assembly 106 may be implemented in any suitable electrical architecture that enables integrated magnetic assembly 106 to function as described herein, including, for example, fly back converters, forward converters, and push-pull converters.

Figure 2:
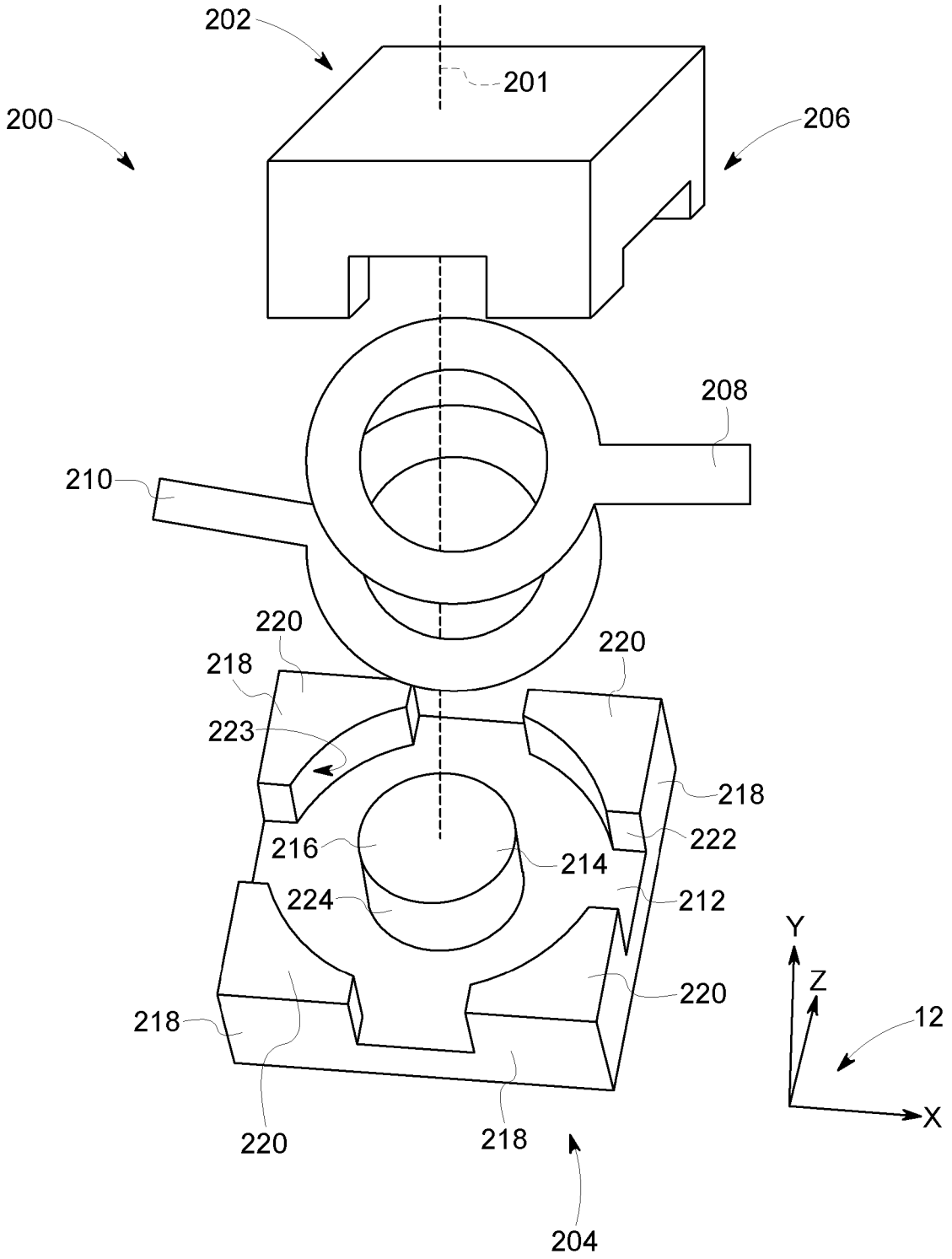
FIG. 2 is an exploded view of an exemplary integrated magnetic assembly, suitable for use in the power converter of FIG. 1.
Figure 3:
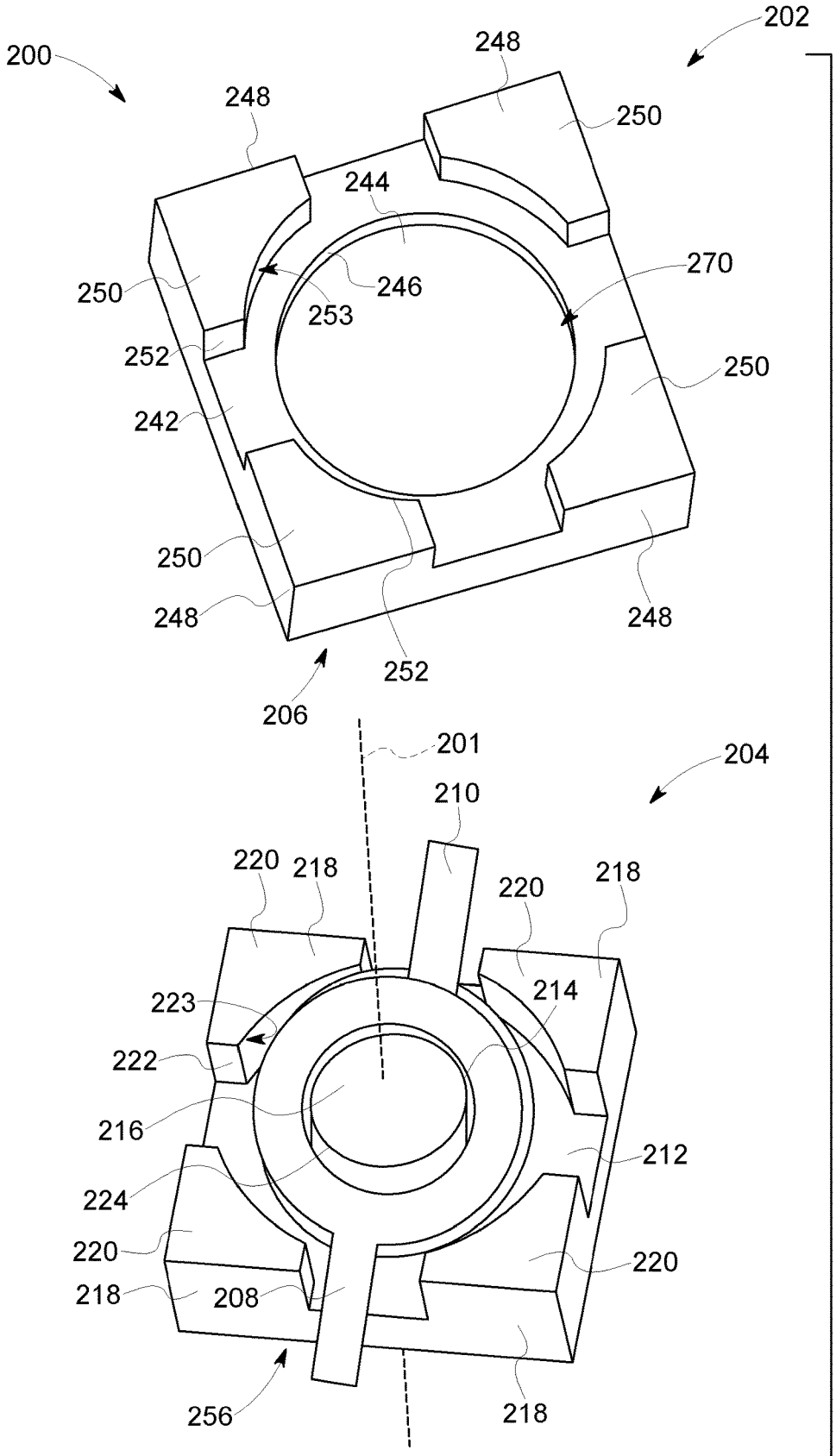
FIG. 3 is another exploded view of the integrated magnetic assembly shown in FIG. 2 including a magnetic core having a first component and a second component, with the second component rotated to reveal underside construction.

FIG. 2 is an exploded view of an exemplary integrated magnetic assembly 200, suitable for use in power converter 100 of FIG. 1. FIG. 3 is another exploded view of the integrated magnetic assembly 200 shown in FIG. 2 including a magnetic core 202 having a first component 204 and a second component 206, with second component 206 rotated to reveal underside construction. A coordinate system 12 includes an X-axis, a Y-axis, and a Z-axis. Integrated magnetic assembly 200 further includes an input winding 208 and an output winding 210. Input winding 208 and output winding 210 are inductively coupled to magnetic core 202, and are generally planar.

In the exemplary embodiment, magnetic core 202 has a generally rectangular cuboid shape formed by first and second components 204, 206. In the exemplary embodiment, first component 204 includes a first face 212 and a winding leg 214 extending from first face 212. First component 204 further includes a plurality of first non-winding legs 218 extending from first face 212. In other words, in the exemplary embodiment, first component 204 has an E-core structure. As used herein, the term "winding leg" refers to a leg of magnetic core 202 arranged to be surrounded by at least one of input winding 208 and output winding 210. As used herein, the term "non-winding leg" refers to legs of magnetic core 202 which are not arranged to be surrounded by input winding 208 or output winding 210. As used herein, the term "E-core" refers to a magnetic component having a winding leg positioned between at least two non-winding legs. In the exemplary embodiment, a vertical axis 201 is defined through a center of winding leg 214.

In the exemplary embodiment, winding leg 214 further includes a top face 216 spaced from and oriented generally parallel to first face 212 and a winding leg sidewall 224 extending from first face 212 to top face 216. In particular, in the exemplary embodiment, winding leg 214 is substantially cylindrical. In alternative embodiments, winding leg 214 has any shape that enables integrated magnetic assembly 200 to function as described herein. In the exemplary embodiment, non-winding legs 218 each include a distal face 220 spaced from and oriented generally parallel to first face 212. In particular, in the exemplary embodiment, first component 204 includes four non-winding legs 218 each located at a respective corner of first component 204. In the exemplary embodiment, non-winding legs 218 each include a sidewall 222 extending between first face 212 of first component 204 and an associated distal face 220 of non-winding legs 218.

In the exemplary embodiment, winding leg 214 is approximately equidistantly spaced from each of non-winding legs 218. In particular, in the exemplary embodiment, sidewalls 222 each include an arcuate portion 223. In the exemplary embodiment, arcuate portion 223 is curved such that a distance between arcuate portion 223 and winding leg sidewall 224 is substantially constant in a direction normal to winding leg sidewall 224. In the exemplary embodiment, sidewall 222 is spaced a sufficient distance from winding leg sidewall 224 to receive one or more segments of input winding 208 and output winding 210 therebetween. In the exemplary embodiment, adjacent non-winding legs 218 are further spaced a sufficient distance from one another to receive one or more segments of input winding 208 and output winding 210 therebetween. In alternative embodiments, non-winding legs 218 are spaced any distance from one another that enables integrated magnetic assembly 200 to function as described herein.

In the exemplary embodiment, first component 204 is coupled to second component 206 via non-winding legs 218. That is, in the exemplary embodiment, distal faces 220 of non-winding legs 218 contact second component 206. In alternative embodiments, a printed circuit board (not shown) is positioned between first component 204 and second component 206 such that distal faces 220 of non-winding legs 218 directly contact the printed circuit board.

In the exemplary embodiment, magnetic core 202 is a ferrite material. In alternative embodiments, magnetic core 202 is any suitable material that enables integrated magnetic assembly 200 to function as described herein, including ferrite polymer composites, powdered iron, sendust laminated cores, tape wound cores, silicon steel, nickel-iron alloys (e.g., MuMETAL®), amorphous metals, and combinations thereof. In the exemplary embodiment, first component 204, non-winding legs 218, and winding leg 214 are fabricated from a single piece of magnetic material. Second component 206 is likewise fabricated from a single piece of magnetic material and coupled to first component 204 via non-winding legs 218.

As best seen in FIG. 3, in the exemplary embodiment, second component 206 includes a second face 242. When integrated magnetic assembly 200 is assembled (shown in FIGS. 4 and 6), first and second faces 212 and 242 in facing relationship with one another. In the exemplary embodiment, second component 206 has an I-core structure. As used herein, the term "I-core" refers to a magnetic component that does not have a winding leg.

In the exemplary embodiment, second component 206 further includes a third face 244 recessed from and oriented generally parallel to second face 242 and a recess sidewall 246 extending between second face 242 and third face 244. Third face 244 and recess sidewall 246 define a recess 270 within second face 242. In the exemplary embodiment, recess sidewall 246 defines a circumferential perimeter of recess 270. That is, recess sidewall 246 is a single annular sidewall. In alternative embodiments, second component 206 may include multiple recess sidewalls. For example, in one alternative embodiment, second component 206 includes four recess sidewalls such that a rectangular shaped recess is defined. In further alternative embodiments, second component 206 includes any number of recess sidewalls 246 that enables integrated magnetic assembly 200 to function as described herein. As described in more detail herein, the configuration of recess sidewall 246 minimizes power losses associated with magnetic flux interference between winding leg 214 and input winding 208 and output winding 210.

In the exemplary embodiment, second component 206 further includes a second plurality of non-winding legs 248 extending from second face 242. In the exemplary embodiment, second non-winding legs 248 each include distal faces 250 spaced from and oriented generally parallel to second face 242. In particular, in the exemplary embodiment, second component 206 includes the same number of non-winding legs 248 as first component 204. Thus, in the exemplary embodiment, second component 206 includes four non-winding legs 248 each extending from a respective corner of second face 242. In the exemplary embodiment, non-winding legs 248 each include a sidewall 252 extending between second face 242 and distal faces 250 of non-winding legs 218. Sidewalls 252 extend towards a respective non-winding leg 218 of first component 204. When first and second components 204, 206 are coupled to one another, first plurality of non-winding legs 218 and second plurality of non-winding legs 248 form four substantially continuous columns extending between first face 212 and second face 242 in the exemplary embodiment.

In the exemplary embodiment, sidewalls 252 each include an arcuate portion 253. In the exemplary embodiment, arcuate portion 253 is curved such that a distance between arcuate portion 253 and winding leg sidewall 224 is substantially constant in a direction normal to winding leg sidewall 224 when magnetic core 202 is assembled. In the exemplary embodiment, adjacent non-winding legs 248 are further spaced a sufficient distance from one another to receive one or more segments of input winding 208 and output winding 210 therebetween. In alternative embodiments, second non-winding legs 248 are spaced any distance from one another that enables integrated magnetic assembly 200 to function as described herein.

Figure 4:
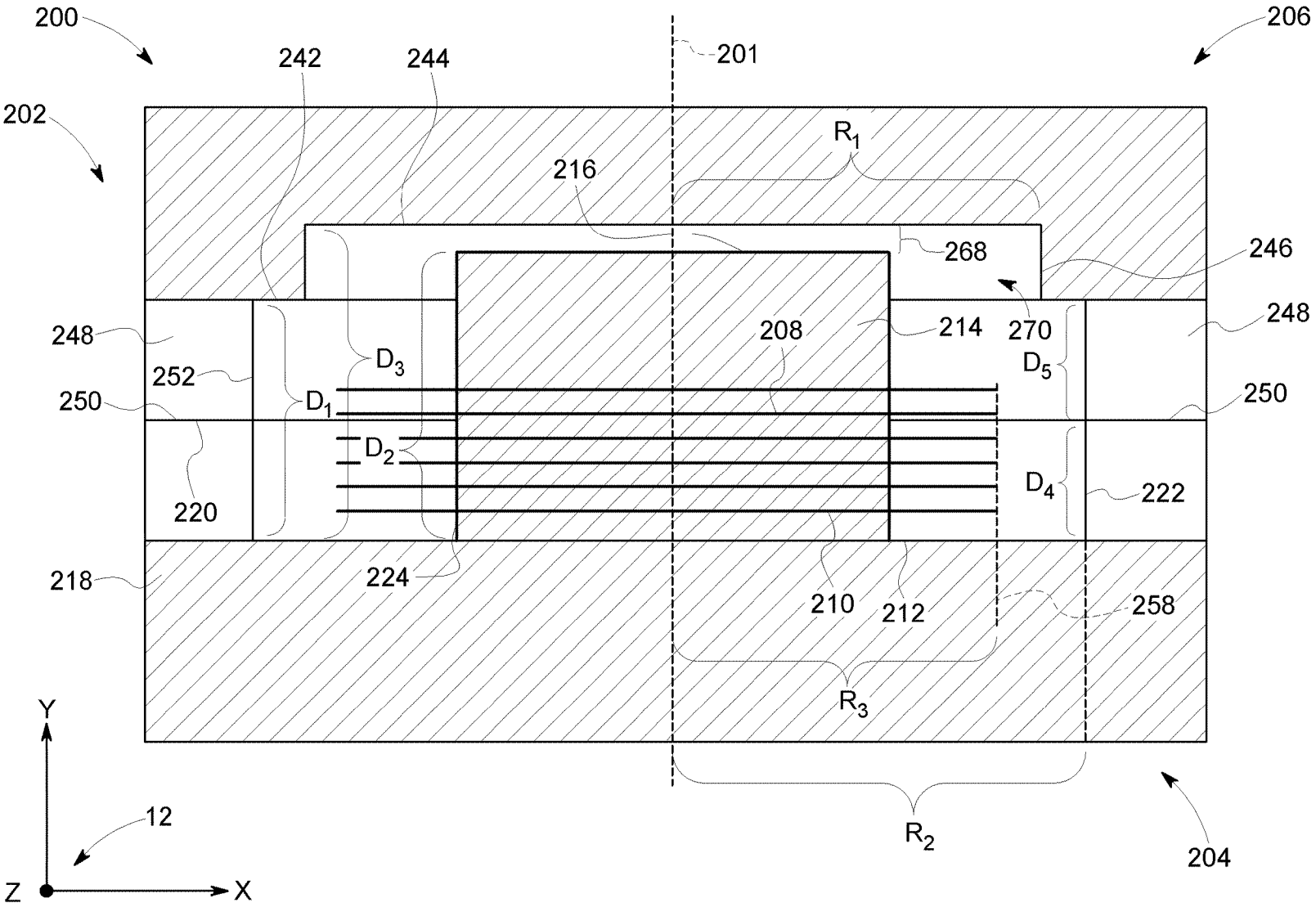
FIG. 4 is a cross-sectional side view of the integrated magnetic assembly shown in FIG. 2.

FIG. 4 is a cross-sectional side view of the integrated magnetic assembly 200 shown in FIG. 2. In the exemplary embodiment, first component 204 is coupled to second component 206 with distal faces 220 of first plurality of non-winding legs 218 and distal faces 250 of second plurality of non-winding legs 248 in contact with one another. In particular, in the exemplary embodiment, distal faces 220, 250 are in contact in a face-to-face relationship with one another. In alternative embodiments, a printed circuit board (not shown) extends between distal faces 220, 250 such that first component 204 and second component 206 are not in contact when magnetic core 202 is assembled.

In the exemplary embodiment, a first distance, indicated generally at Di, is defined as the distance along the Y-axis between second face 242 and first face 212. A second distance, indicated generally at $D_2$, is defined as the distance between top face 216 of winding leg 214 and first face 212. A third distance, indicated generally at $D_3$, is defined as the distance between third face 244 and first face 212. A fourth distance, indicated generally at $D_4$, is defined as a height of first plurality of non-winding legs 218. A fifth distance, indicated generally at $D_5$, is defined as a height of second plurality of non-winding legs 248. In the exemplary embodiment, $D_1$ is approximately 3.7 millimeters (mm), $D_2$ is approximately 4 mm, $D_3$ is approximately 4.9 mm, $D_4$ is approximately 1.85 mm, and $D_5$ is approximately 1.85 mm. In alternative embodiments, $D_1$-$D_5$ are any length that enables magnetic core 202 to function as described herein.

In the exemplary embodiment, non-winding legs 218, 248, first face 212, and second face 242 collectively define openings 256 (shown in FIG. 3). In particular, openings 256 are sized to allow at least one of input winding 208 and output winding 210 to pass therethrough.

In the exemplary embodiment, winding leg 214 extends into recess 270 defined within second face 242 such that top face 216 of winding leg 214 is located between second face 242 and third face 244. In other words, in the exemplary embodiment, second distance $D_2$ is greater than first distance $D_1$ and less than third distance $D_3$. In alternative embodiments, first distance $D_1$ is greater than second distance $D_2$.

In the exemplary embodiment, height $D_4$ of first plurality of non-winding legs 218 is substantially equal to height $D_5$ of second plurality of non-winding legs 248. Thus, in the exemplary embodiment, second distance $D_2$ is more than double the height $D_4$ of non-winding legs 218. In alternative embodiments, first plurality of non-winding legs 218 and second plurality of non-winding legs 248 are sized such that fourth distance $D_4$ is different than fifth distance $D_5$. For example, in some embodiments, first plurality of non-winding legs 218 and second plurality of non-winding legs 248 are sized such that fourth distance $D_4$ is less than fifth distance $D_5$.

In the exemplary embodiment, top face 216 of winding leg 214 is spaced from third face 244 such that an air gap 268 is defined between top face 216 and third face 244. Air gap 268 facilitates providing magnetic core 202 with a desired inductance and/or saturation current, as described in detail herein.

Figure 5A:
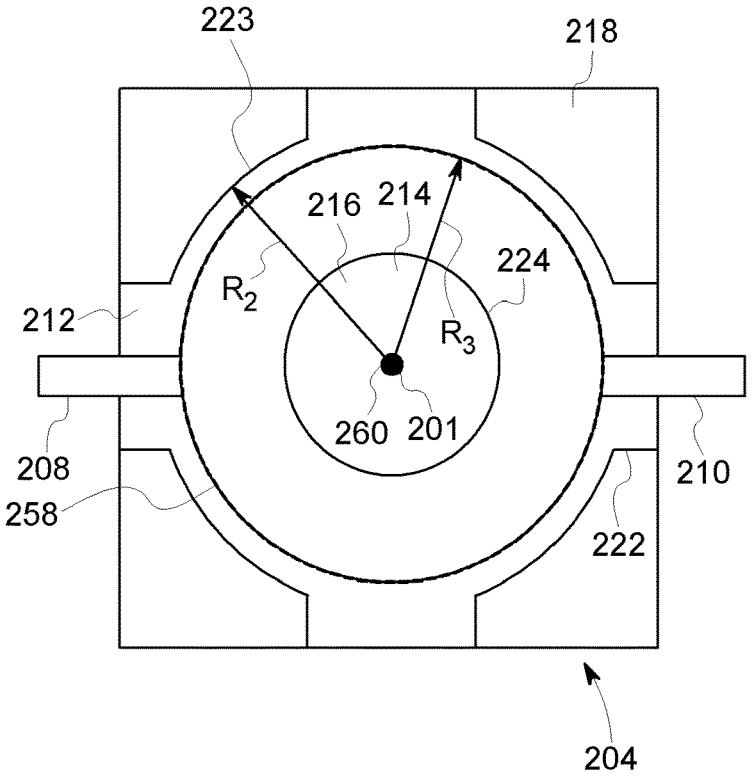
FIG. 5A is a top view of the first component shown in FIG. 2.
Figure 5B:
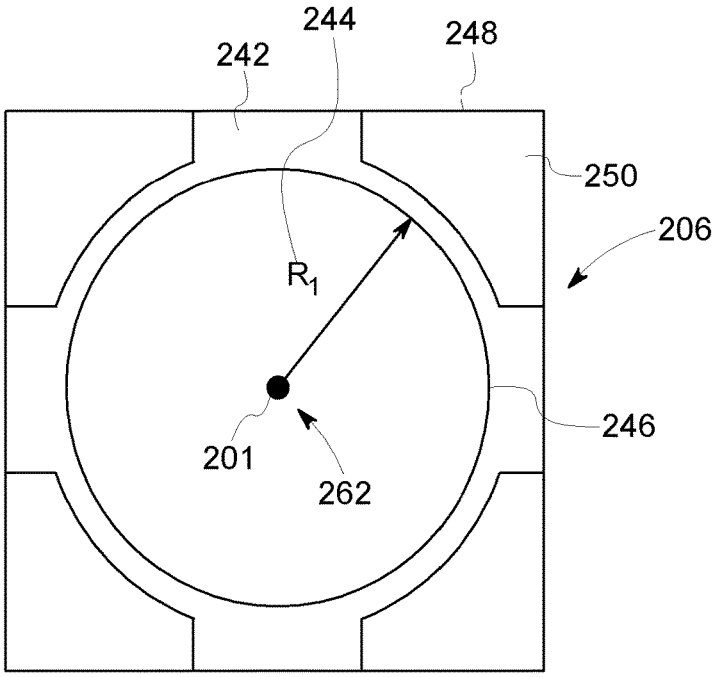
FIG. 5B is a bottom view of the second component shown in FIG. 2.

FIG. 5A is a top view of first component 204 shown in FIG. 2. FIG. 5B is a bottom view of second component 206 shown in FIG. 2. Vertical axis 201 extends through a winding leg center 260. Vertical axis 201 also extends through a third face center 262. When first component 204 is coupled to second component 206, center point 262 of third face 244 is aligned with winding leg center 260 in the exemplary embodiment.

In the exemplary embodiment, third face 244 has a substantially circular shape. In alternative embodiments, when winding leg 214 has, for example, a rectangular shape, third face 244 also has a substantially rectangular shape. In further alternative embodiments, third face 244 has any shape that enables integrated magnetic assembly 200 to function as described herein. In the exemplary embodiment, a first radius, indicated at $R_1$, is defined as the radius from third face center point 262 to recess sidewall 246. A second radius, indicated at $R_2$, is defined as the radius from winding leg center 260 to arcuate portion 223. A third radius, indicated at $R_3$, is defined as the radius from winding leg center 260 to an outer winding perimeter 258. Outer winding perimeter 258 is the outer perimeter of the annular portions of input winding 208 and output winding 210, in the exemplary embodiment.

In the exemplary embodiment, first radius $R_1$ is less than second radius $R_2$. Further, in the exemplary embodiment, first radius $R_1$ is greater than third radius $R_3$. In alternative embodiments, third face 244 is sized such that first radius $R_1$ is greater than second radius $R_2$. In further alternative embodiments, first radius $R_1$ is less than third radius $R_3$.

Figure 6:
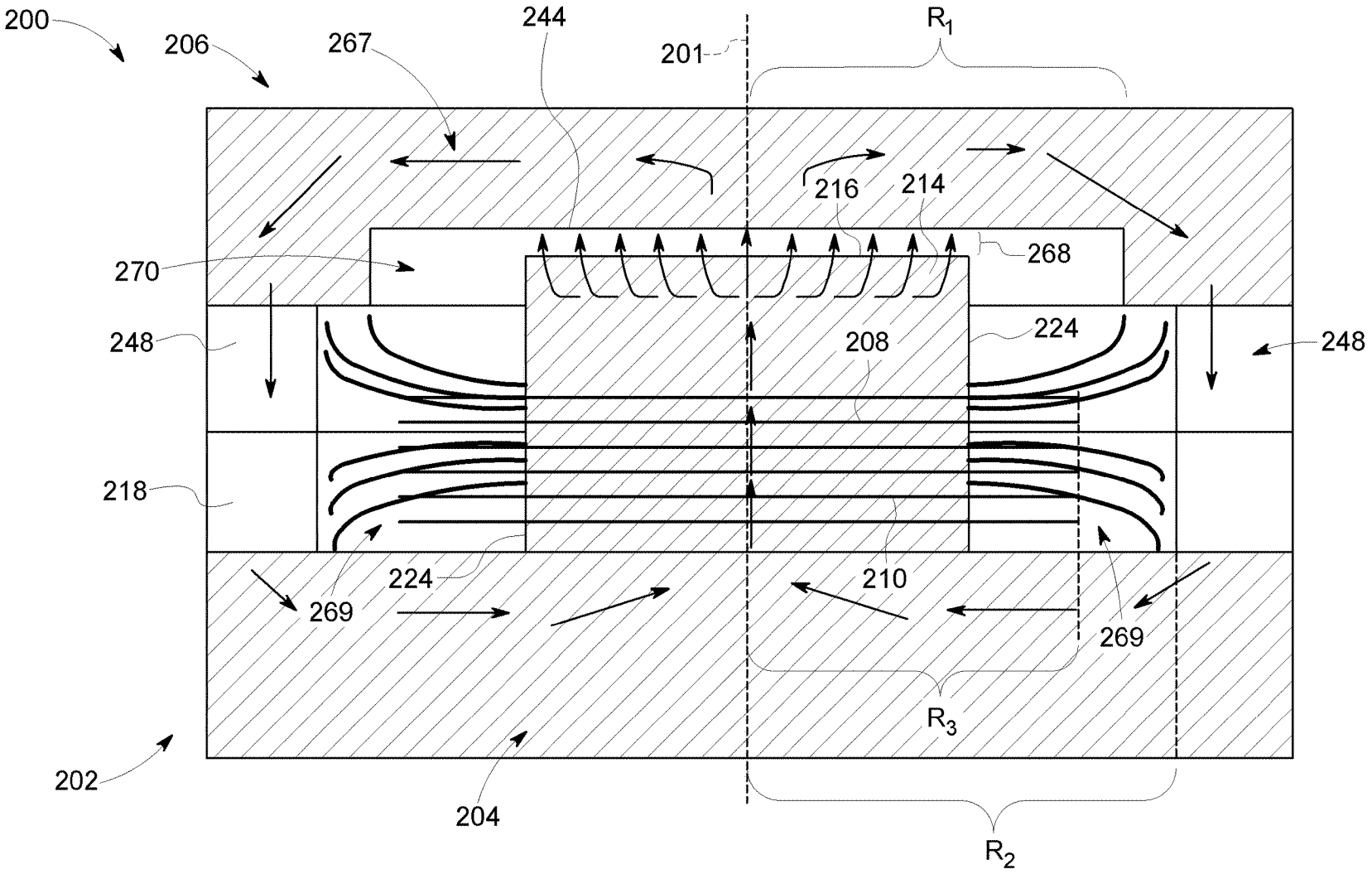
FIG. 6 is a cross-sectional side view of the integrated magnetic assembly shown in FIG. 2 including lines schematically representing flux flow within the integrated magnetic assembly during operation.

FIG. 6 is a cross-sectional side view of integrated magnetic assembly 200 shown in FIG. 2 including lines schematically representing a main magnetic flux path 267 and a fringing flux 269 within integrated magnetic assembly 200 during operation. In particular, in the exemplary embodiment, when input winding 208 is coupled to an electrical current, magnetic flux flows along the main magnetic flux path 267 as shown. Further, in the exemplary embodiment, at least in part due to the presence of air gap 268, fringing flux 269 flows outward from winding leg sidewall 224.

In the exemplary embodiment, providing air gap 268 within recess 270 facilitates directing fringing flux 269 generated by input winding 208 and output winding 210. In particular, providing air gap 268 within recess 270 facilitates altering the orientation of the flow of fringing flux 269 relative to input winding 208 and output winding 210. Thus, in the exemplary embodiment, fringing flux 269 flows from winding leg 214 through input winding 208 and output winding 210 in a direction generally perpendicular to winding leg sidewall 224. That is, in the exemplary embodiment, fringing flux 269 flows radially outward from winding leg 214 through input winding 208 and output winding 210 at a direction generally parallel to input winding 208 and output winding 210. This configuration minimizes power losses associated with magnetic flux interference between input winding 208 and output winding 210. In particular, as will be described in greater detail with respect to FIGS. 7A and 7B, parallel fringing flux 269 reduces power loss caused by induced eddy currents within input winding 208 and output winding 210 from fringing flux 269.

Power losses in magnetic structures may be measured as an alternating current coefficient (AC coefficient), or alternatively, eddy-current loss coefficient, of magnetic core 202. The AC coefficient of a magnetic structure is a numerical representation of the power loss in an alternating current transformer operating at a given frequency. In particular, the power loss for a given magnetic core 202 may be determined as a function of the AC coefficient multiplied by the resistance in the circuit and multiplied by the square of current. Thus, the greater the AC coefficient of a magnetic core, the greater the winding loss will be for a given current and resistance. In the exemplary embodiment, when magnetic core 202 is inductively coupled to power converter 100, magnetic core 202 has an AC coefficient of at least less than 5. In particular, in the exemplary embodiment, the AC coefficient of magnetic core 202 is 2.63.

In the exemplary embodiment, magnetic core 202 used in power converter 100 (shown in FIG. 1) is a buck-boost inductor. In particular, in the exemplary embodiment, input voltage $V_{in}$ is equal to approximately 380 volts. Output voltage $V_{out}$ is equal to approximately 28 volts. Further, in the exemplary embodiment, alternating current is oscillating at a frequency of 600 kHz/sec.

Figure 7A:
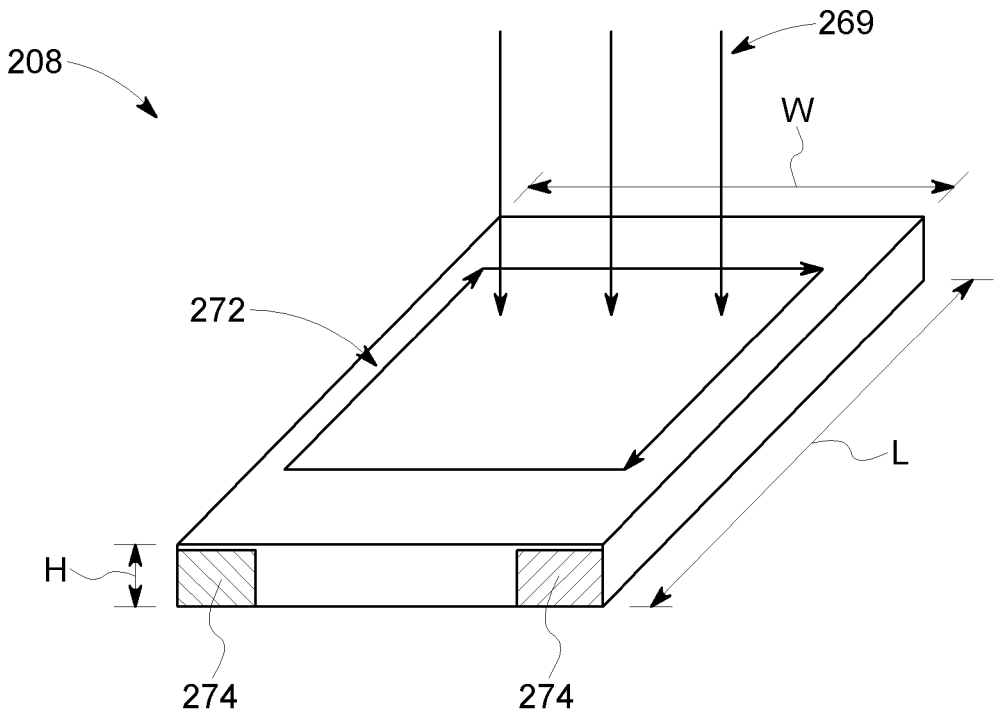
FIG. 7A is a schematic perspective of an input winding in which fringing flux flows generally perpendicular to a width of the input winding.
Figure 7B:
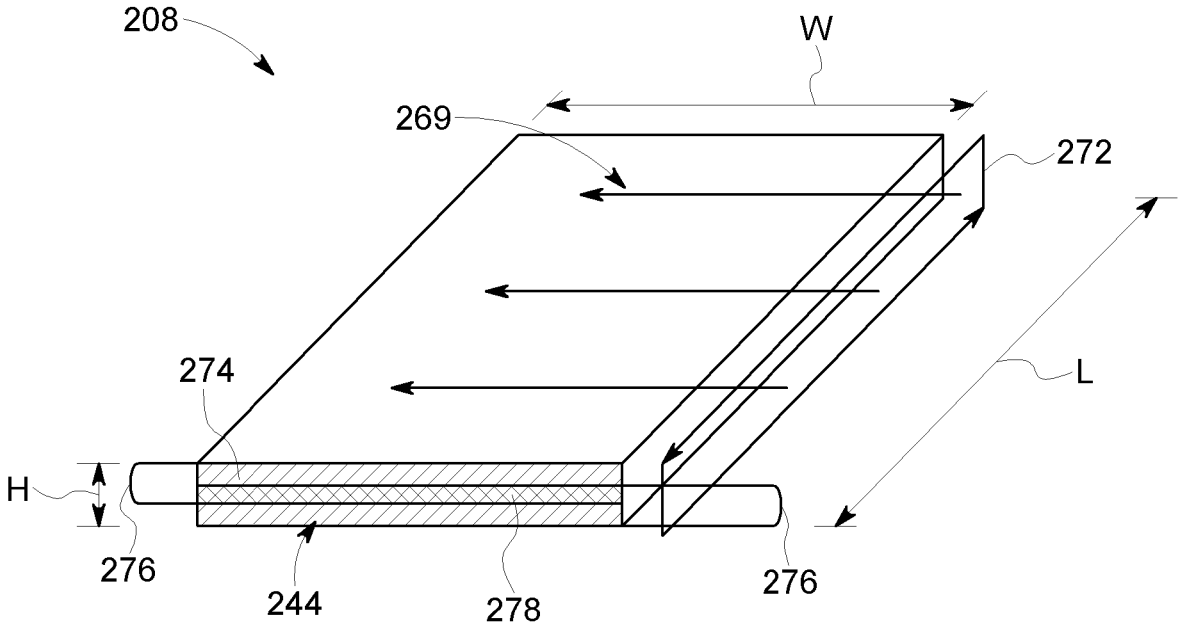
FIG. 7B is a schematic perspective of an input winding when coupled to the magnetic core shown in FIG. 6, in which fringing flux flows generally parallel to the width of the input winding.

FIG. 7A is a schematic perspective of an input winding 208 which fringing flux 269 flows generally perpendicular to a width, indicated at W, of input winding 208. FIG. 7B is a schematic perspective of input winding 208 when coupled to exemplary magnetic core 202 (shown in FIG. 6), in which fringing flux 269 flows generally parallel to width W of input winding 208. In the exemplary embodiment, input winding 208 has a length, indicated at L, shown elongated in the schematic. In particular, length L corresponds to the total length of input winding 208 wrapped around winding leg 214 (shown in FIG. 2). Input winding 208 further includes a height, indicated at H.

In the exemplary embodiment, fringing flux 269 induces an eddy current 272 within input winding 208. Specifically, fringing flux 269 flows in a first direction, and eddy current 272 flows around fringing flux in a plane perpendicular to the first direction. Within input winding 208, eddy current 272 flows in a flow area 274.

As shown in FIG. 7A, the first direction of fringing flux 269 is generally perpendicular to width W. Thus, eddy current 272 flows in a plane along width W and length L. In the exemplary embodiment, flow areas 274 of eddy current 272 are separated at different ends of width W and do not overlap.

In contrast, as shown in FIG. 7B, the first direction of fringing flux 269 is generally parallel to width W. Thus, eddy current 272 flows in a second direction along length L and height H. In this embodiment, flow areas 274 overlap one another. This is because width W of input winding 208 is larger than height H. Specifically, in the exemplary embodiment, flow areas 274 of eddy current 272 have a skin depth 276. Skin depth 276 is the depth of eddy current flow 272 within input winding 208. In the exemplary embodiment, skin depth 276 in FIG. 7B is approximately 0.085 mm. That is, eddy current 272 flows along a depth greater than half of height H as eddy current 272 flows along length L of input winding 208. As a result, eddy current flow 272 will overlap at an overlapping region, generally indicated at 278. Thus, in the exemplary embodiment, due to the overlap, eddy current 272 will partially cancel itself out as it flows through input winding 208, thereby reducing power losses. In alternative embodiments, skin depth 276 of eddy current 272 may be less than half of height H. Therefore, in the exemplary embodiment, as shown in FIG. 7B, wherein fringing flux 269 flows in a direction generally parallel to width W, power losses in input winding 208 caused by induced eddy currents 272 within input winding 208 are lower compared to known magnetic cores wherein the direction of fringing flux 269 is generally perpendicular to width W.

Figure 8:
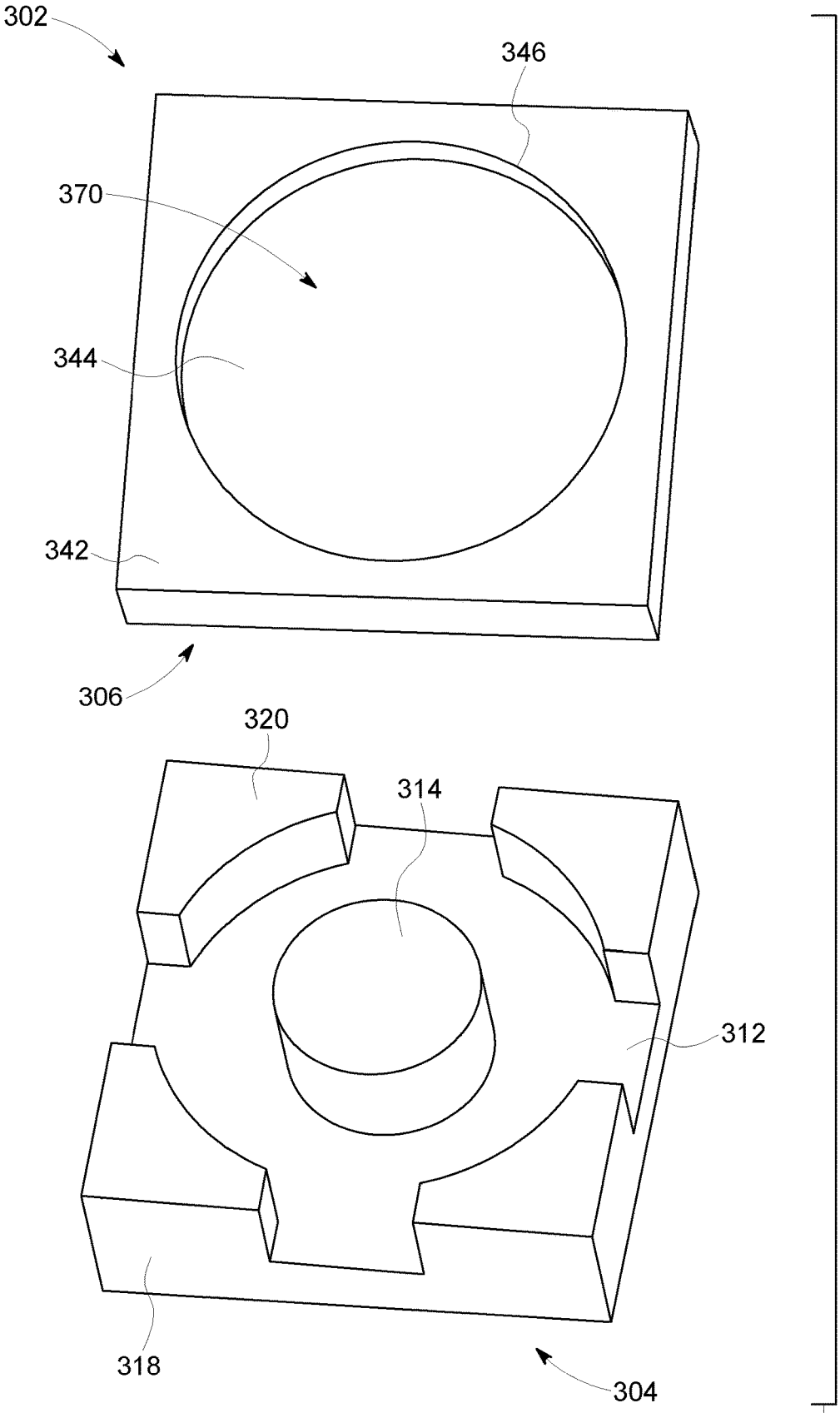
FIG. 8 is an exploded view of an exemplary magnetic core, suitable for use in the power converter of FIG. 1, having a first component and a second component, with the second component rotated to reveal underside construction.
Figure 9:
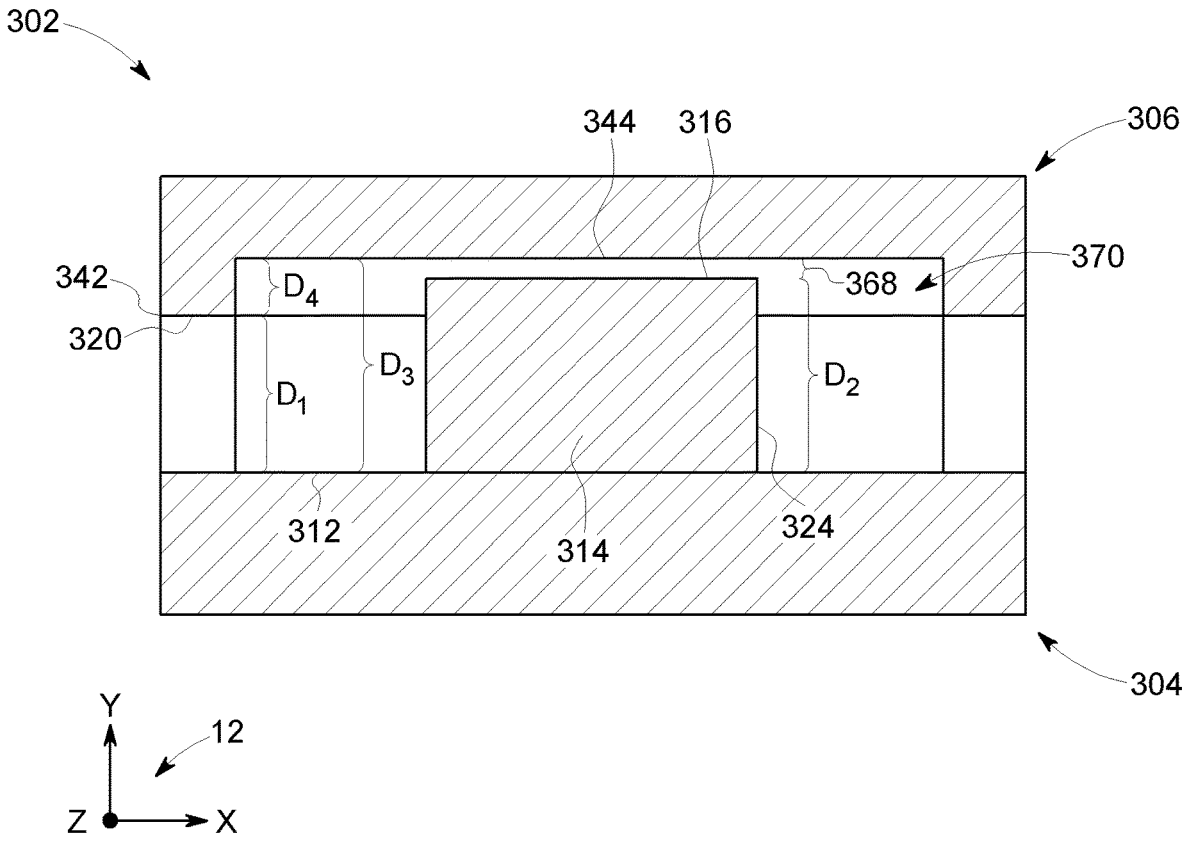
FIG. 9 is a cross-sectional side view of the magnetic core shown in FIG. 7.

FIG. 8 is an exploded view of an alternative exemplary magnetic core 302, suitable for use in power converter 100 of FIG. 1, having a first component 304 and a second component 306, with second component 306 rotated to reveal underside construction. FIG. 9 is a cross-sectional side view of the magnetic core 302 shown in FIG. 8.

In the exemplary embodiment, when assembled, magnetic core 302 has a generally rectangular cuboid shape formed by first and second components 304, 306. In the exemplary embodiment, first component 304 includes a first face 312 and a winding leg 314 extending from first face 312. First component 304 further includes a first plurality of non-winding legs 318 extending from first face 312. In other words, in the exemplary embodiment, first component 304 has an E-core structure. That is, in the exemplary embodiment, other the comparative heights between winding leg 314 and non-winding legs 318, as discussed in detail below, first component 304 has substantially the same construction as first component 204 (shown in FIGS. 2-6).

In the exemplary embodiment, second component 306, includes a second face 342. When magnetic core 302 is assembled (as shown in FIG. 8), first and second faces 312, 342 face one another. In the exemplary embodiment, second component 306 has an I-core structure.

In the exemplary embodiment, second component 306 further includes a third face 344 recessed from and oriented generally parallel to second face 342 and a recess sidewall 346 extending between second face 342 and third face 344. Third face 344 and recess sidewall 346 define a recess 370 within second face 342. In the exemplary embodiment, recess sidewall 346 defines a circumferential perimeter of recess 370. That is, recess sidewall 346 is a single, annular sidewall. In alternative embodiments, second component 306 may include multiple recess sidewalls. For example, in one alternative embodiment, second component 306 includes four recess sidewalls such that a rectangular shaped recess is defined. In further alternative embodiments, second component 306 includes any number of recess sidewalls 346 that enables magnetic core 302 to function as described herein. As described in more detail herein, the configuration of recess sidewall 346 minimizes power losses associated magnetic flux interference between different components integrated on magnetic core 302.

In the exemplary embodiment, a first distance, indicated generally at Di, is defined as the distance along the Y-axis between second face 342 and first face 312. A second distance, indicated generally at $D_2$, is defined as the distance between a top face 316 of winding leg 314 and first face 312. A third distance, indicated generally at $D_3$, is defined as the distance between third face 344 and first face 312. A fourth distance, indicated generally at $D_4$, is defined as the distance between third face 344 and second face 342. In the exemplary embodiment, $D_1$ is approximately 3.7 mm, $D_2$ is approximately 4 mm, $D_3$ is approximately 4.9 mm and $D_4$ is approximately 1.2 mm. In alternative embodiments, $D_1$-$D_4$ are any length that enables magnetic core 302 to function as described herein.

In the exemplary embodiment, apart from recess sidewall 346 and third face 344, second face 342 extends as a substantially unbroken plane. In other words, in the exemplary embodiment, second component 306 does not comprise any non-winding legs extending from second face 342. As such, in the exemplary embodiment, when magnetic core 302 is assembled, non-winding legs 318 contact second face 342. In particular, in the exemplary embodiment, second face 342 and a distal face 320 of non-winding legs 318 are in contact in a face-to-face relationship with one another. In alternative embodiments, a printed circuit board (not shown) extends between second face 342 and distal face 320 of non-winding legs 318 such that first component 304 and second component 306 are not in contact when magnetic core 302 is assembled. In further alternative embodiments, first component 304 and second component 306 are coupled in any manner that enables magnetic core 302 to function as described herein.

In the exemplary embodiment, first distance $D_1$ of is greater than half second distance $D_2$. In particular, in the exemplary embodiment, first distance $D_1$ is approximately 75% of second distance $D_2$. In alternative embodiments, first distance $D_1$ is less than 50% of second distance $D_2$. Further, in the exemplary embodiment, first component 304 and second component 306 are sized such that third distance $D_3$ is greater than second distance $D_2$. Thus, in the exemplary embodiment, top face 316 of winding leg 314 is spaced from third face 344, such that an air gap 368 is provided within magnetic core 302. In particular, providing air gap 368 within recess 370 facilitates altering the orientation of the flow of fringing flux similarly as described above with respect to FIG. 6 when an input winding and an output winding are inductively coupled to winding leg 314. Accordingly, when an input winding and output winding are coupled to winding leg 314, fringing flux (shown in FIG. 6) flows from winding leg 314 in a direction generally perpendicular to a winding leg sidewall 324, thereby reducing power loss caused by induced eddy currents within the input winding and output winding.

Figure 10:
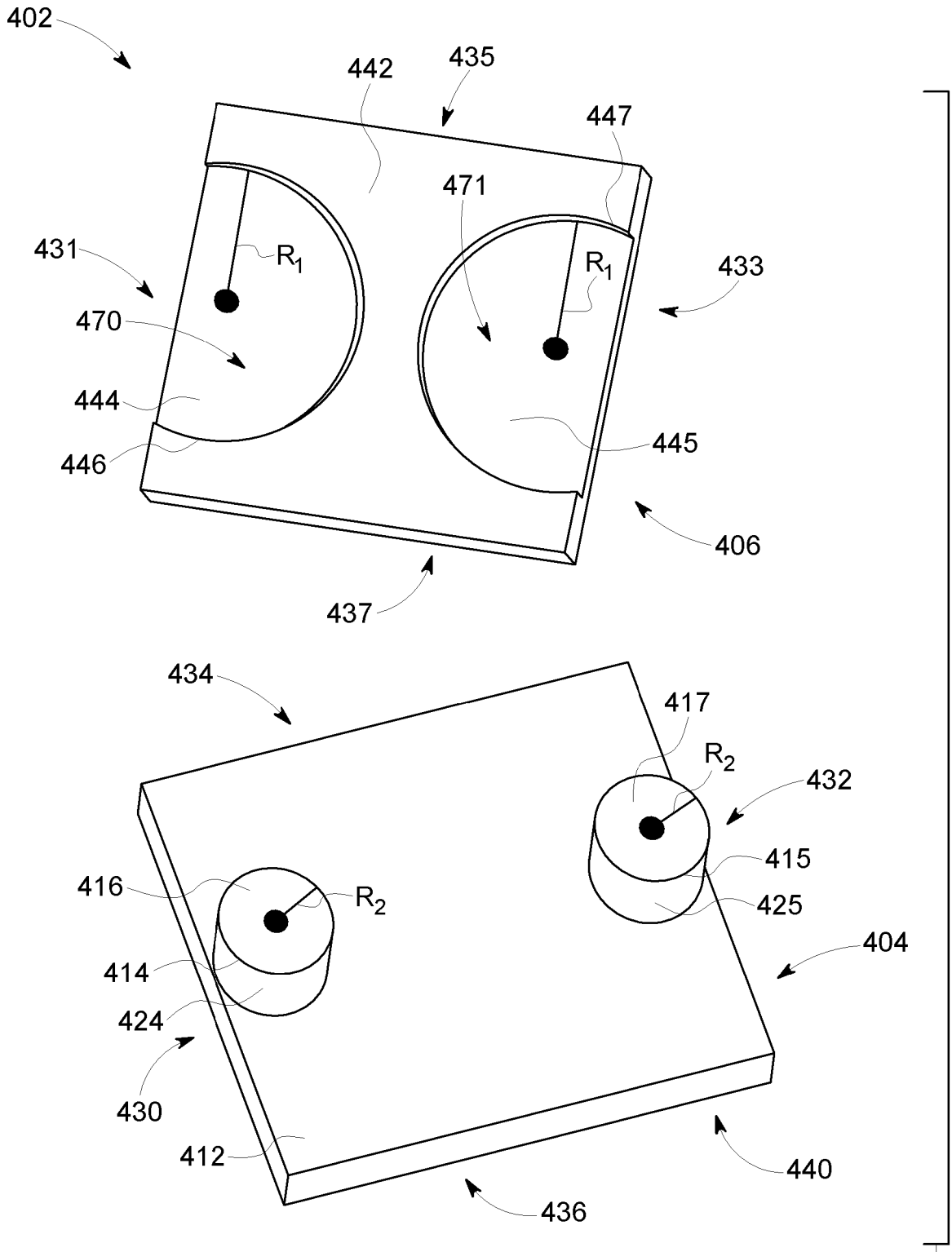
FIG. 10 is an exploded view of an exemplary magnetic core, suitable for use in power converter of FIG. 1, including a first component and a second component, with the second component rotated to reveal underside construction.
Figure 11:
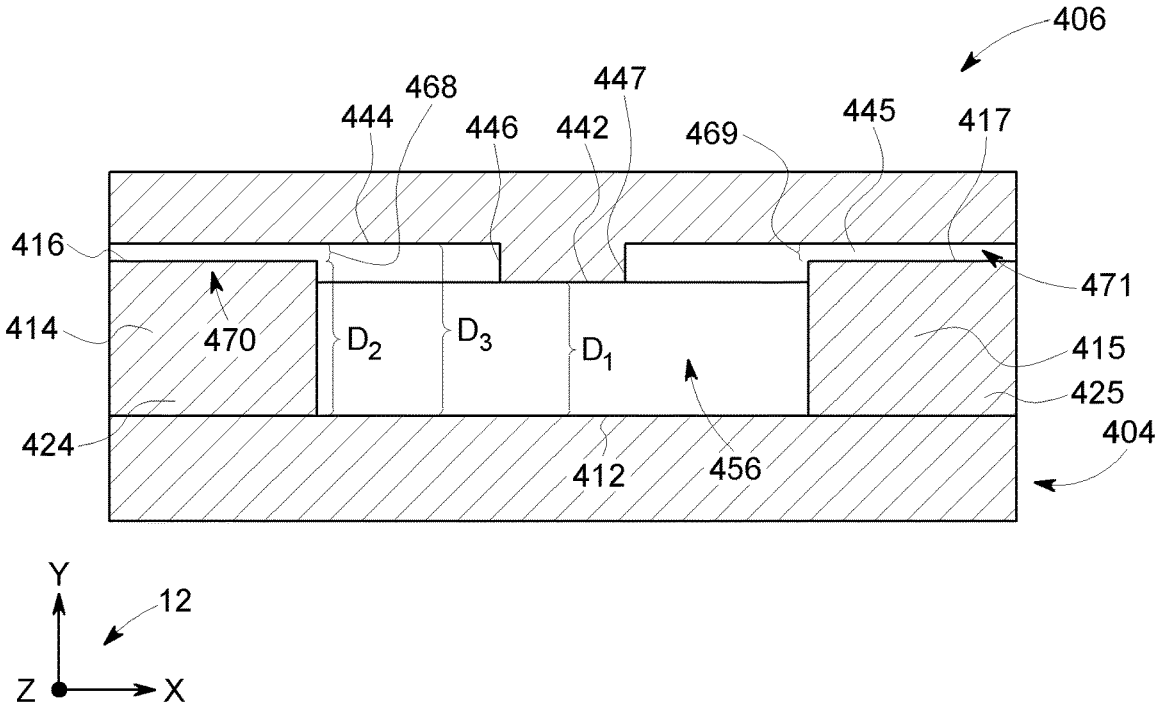
FIG. 11 is a cross-sectional side view of magnetic core shown in FIG. 9.

FIG. 10 is an exploded view of an alternative exemplary magnetic core 402, including a first component 404 and a second component 406, suitable for use in power converter 100 of FIG. 1, with second component 406 rotated to reveal underside construction. FIG. 11 is a cross-sectional side view of magnetic core 402 shown in FIG. 10.

In the exemplary embodiment, first component 404 has a "U-core structure" including six sides and two winding legs 414, 415. As used herein, the term "U-core" refers to a magnetic component for use in a magnetic core having at least two winding legs and no non-winding legs. The six sides of first component 404 include a first side 430, an opposing second side 432, and first and second opposing ends 434 and 436 extending between first side 430 and second side 432. First component 404 further includes a first face 412 extending between and generally oriented orthogonal to first side 430, second side 432, first end 434, and second end 436. In the exemplary embodiment, winding legs 414, 415 include a first winding leg 414 and a second winding leg 415 extending from first face 412. In alternative embodiments, first component 404 includes any number of winding legs 414, 415 that enables magnetic core 402 to function as described herein.

In the exemplary embodiment, first and second winding legs 414 and 415 each include respective top faces 416 and 417 spaced from and oriented generally parallel to first face 412. First and second winding legs 414 and 415 each further include respective winding leg sidewalls 424 and 425 extending from first face 412 to top faces 416 and 417. In the exemplary embodiment, winding legs 414 and 415 have substantially the same shape as winding leg 214, described above.

In the exemplary embodiment, first winding leg 414 is positioned adjacent first side 430 at a distance approximately midway between first end 434 and second end 436. Second winding leg 415 is positioned adjacent second side 432 at a distance approximately midway between first end 434 and second end 436. Thus, in the exemplary embodiment, first winding leg 414 and second winding leg 415 are aligned. In alternative embodiments, first winding leg 414 and second winding leg 415 are positioned in any manner that enables magnetic core 402 to function as described herein.

In the exemplary embodiment, second component 406 has a generally rectangular shape having six sides. Specifically, in the exemplary embodiment, second component 406 has an I-core structure. The six sides of second component 406 include a third side 431, an opposing fourth side 433, and third and fourth opposing ends 435 and 437 extending between third side 431 and fourth side 433. Second component 406 further includes a second face 442 extending between and oriented generally orthogonal to third side 431, fourth side 433, third end 435, and fourth end 437. When magnetic core 402 is assembled (shown in FIG. 11), first and second faces 412 and 442 face one another.

In the exemplary embodiment, second component 406 further includes a third face 444 and a fourth face 445. In the exemplary embodiment, third face 444 and a fourth face 445 are recessed from and oriented generally parallel to second face 442. In the exemplary embodiment, second component 406 includes a first recess sidewall 446 extending between second face 442 and third face 444. Second component 406 further includes a second recess sidewall 447 extending between second face 442 and fourth face 445. Third face 444 and first recess sidewall 446 define a first recess 470 within second face 442. Fourth face 445 and second recess sidewall 447 define a second recess 471 within second face 442. In the exemplary embodiment, third faces 444 and 445 are positioned at a substantially equal depth. In particular, in the exemplary embodiment, third face 444 and fourth face are substantially coplanar with one another. In alternative embodiments, third faces 444, 445 are positioned at different depths.

In the exemplary embodiment, recess sidewalls 446 and 447 each define a circumferential perimeter of the respective recesses 470 and 471 defined within second face 442. That is, recess sidewalls 446 and 447 are each a single, annular sidewall. In alternative embodiments, second component 406 includes any number of recess sidewalls 446 and 447 that enable magnetic core 402 to function as described herein.

In the exemplary embodiment, first component 404 is coupled to second component 406 via a printed circuit board (not shown) arranged to support second component 406 a distance above first component 404, as shown in FIG. 11. In particular, in the exemplary embodiment, magnetic core 402 is coupled to the printed circuit board such that the printed circuit board supports second component 406 while inhibiting contact between first component 404 and second component 406.

In the exemplary embodiment, apart from recess sidewalls 446 and 447 and third faces 444 and 445, second face 442 extends as a substantially unbroken plane between sides 431 and 433 and ends 435 and 437. In other words, in the exemplary embodiment, second component 406 does not include any non-winding legs extending from second face 442.

In the exemplary embodiment, a first distance, indicated generally at Di, is defined as the distance between second face 442 and first face 412. A second distance, indicated generally at $D_2$, is defined as the distance between top faces 416 and 417 of respective winding legs 414 and 415 and first face 412. In the exemplary embodiment, the second distance $D_2$ is substantially the same for first winding leg 414 and second winding leg 415. In alternative embodiments, winding legs 414 and 415 extend different distances from first face 412 such that second distance $D_2$ is not the same for each winding leg 414 and 415. A third distance, indicated generally at $D_3$, is defined as the distance between each third face 444 and 445 and first face 412. In the exemplary embodiment, $D_1$ is approximately 3 mm, $D_2$ is approximately 3.5 mm, $D_3$ is approximately 4 mm. In alternative embodiments, $D_1$-$D_3$ are any length that enables magnetic core 402 to function as described herein.

In the exemplary embodiment, winding legs 414 and 415, first face 412, and second face 442 collectively define a channel 456. In particular, channel 456 is sized to allow at least one of an input winding (similar to input winding 208 as shown in FIG. 2) and an output winding (similar to output winding 210 as shown in FIG. 2) to pass therethrough. In the exemplary embodiment, when an input winding and output winding are coupled to winding legs 414 and 415, a main magnetic flux path (not shown) flows between first component 404 and second component 406 through winding legs 414 and 415.

In the exemplary embodiment, winding legs 414 and 415 each extend into respective recesses 470 and 471 defined within second face 442 such that top faces 416 and 417 of winding legs 414 and 415 are each located between second face 442 and respective third faces 444 and 445. In other words, in the exemplary embodiment, second distance $D_2$ is greater than first distance $D_1$ and less than third distance $D_3$. In alternative embodiments, first distance $D_1$ is greater than second distance $D_2$.

In the exemplary embodiment, top faces 416 and 417 of winding legs 414 and 415 are spaced from third faces 444 and 445 such that air gaps 468 and 469 are respectively provided within magnetic core 402. Air gaps 468 and 469 provide magnetic core 402 with a desired inductance and/or saturation current.

In the exemplary embodiment, third faces 444 and 445 are sized in relation to respective winding legs 414 and 415. Further, third faces 444 and 445 are also shaped to correspond to the shapes of winding legs 414 and 415. In particular, third faces 444 and 445 are sized to have a first radius, indicated generally at $R_1$. Further, winding leg top faces 416 and 417 have a second radius, indicated generally at $R_2$. In the exemplary embodiment, third faces 444 and 445 have a substantially semi-circular shape that aligns with the substantially circular shape of winding legs 414 and 415. In alternative embodiments, when winding legs 414 and 415 have, for example, a rectangular shape (not shown), third faces 444 and 445 also have a corresponding rectangular shape. In further alternative embodiments, third faces 444 and 445 have any shape that enables magnetic core 402 to function as described herein.

Figure 12:
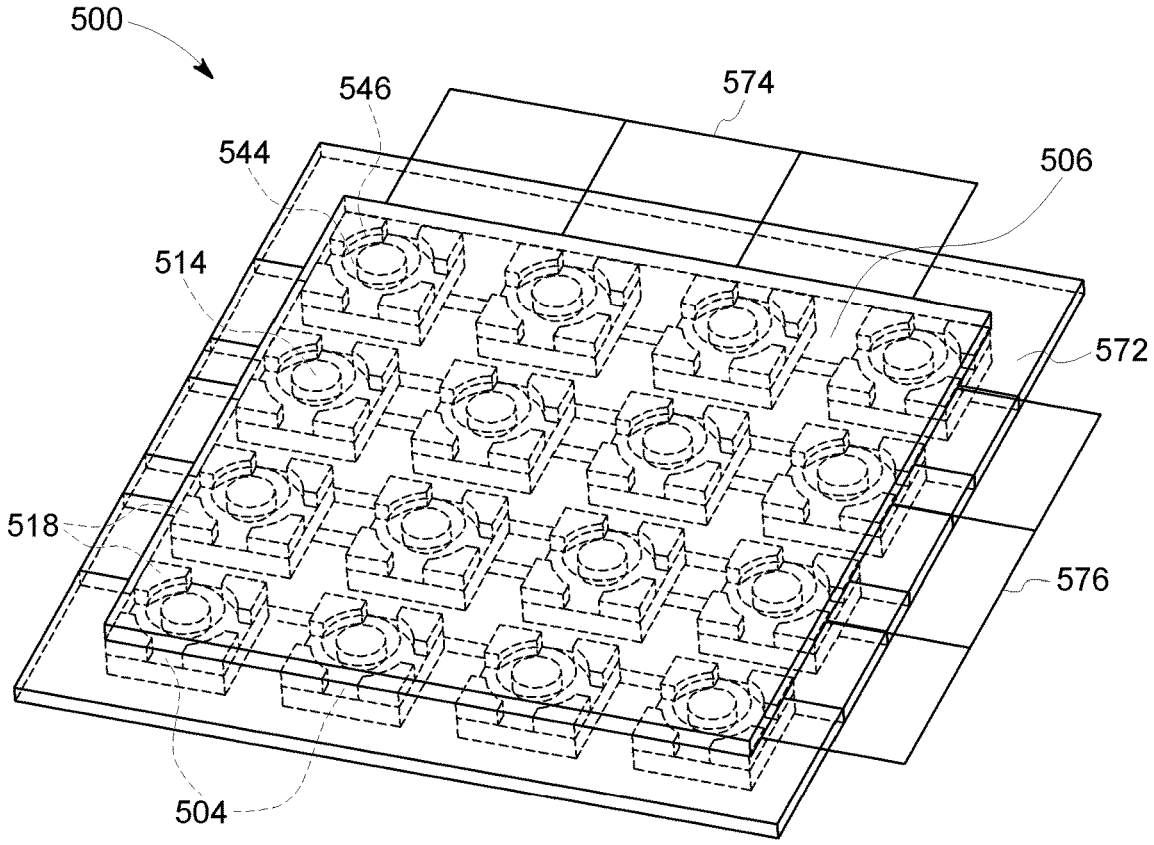
FIG. 12 is a perspective view of an exemplary integrated magnetic assembly suitable for use in the power converter of FIG. 1.

FIG. 12 is a perspective view of an integrated magnetic assembly 500 suitable for use in power converter 100 of FIG. 1. In the exemplary embodiment, integrated magnetic assembly 500 includes a plurality of first components 504, a second component 506, and a printed circuit board 572 positioned between first components 504 and second component 506.

In the exemplary embodiment, each of plurality of first components 504 has the same E-core structure as first component 304 (shown in FIG. 8). Additionally, in the exemplary embodiment, second component 506 has the same structure as a plurality of second components 306 (shown in FIG. 6) coupled together, with each third face 544 positioned respectively above each winding leg 514 of first components 504. In other words, in the exemplary embodiment, second component 506 comprises a corresponding third face 544 and recess sidewall 546 for each first component 504. Additionally, in the exemplary embodiment, second component 506 does not include non-winding legs. That is, in the exemplary embodiment, second component 506 is a single unitarily formed I-core magnetic component, having a plurality of third faces 544 and recess sidewalls 546. In alternative embodiments, second component 506 further includes a plurality of second non-winding legs.

In the exemplary embodiment, first components 504 are arranged in a matrix formation. The matrix formation includes first components 504 arranged in rows, indicated generally at 574, and columns, indicated generally at 576. In the exemplary embodiment, rows 574 and columns 576 are arranged such that each first component 504 of plurality of first components is substantially equidistantly spaced from adjacent first components 504. In alternative embodiments, rows 574 and columns 576 are arranged in any manner that enables integrated magnetic assembly 500 to function as described herein. In the exemplary embodiment, each row 574 includes four first components 504. Further, each column 576 includes four first components 504. Thus, in the exemplary embodiment, plurality of first components 504 includes sixteen first components 504. Additionally, in the exemplary embodiment, second component 506 includes sixteen third faces 544 and sixteen recess sidewalls 546 in correspondence with each first component 504. In alternative embodiments, integrated magnetic assembly 500 includes any number of first components 504 and any number of corresponding third faces 244 and recess sidewalls 546 that enables integrated magnetic assembly 500 to function as described herein.

An exemplary technical effect of the methods, systems, and apparatus described herein includes at least one of: (a) reduced power loss resulting from eddy currents generated in conductive winding during operation of integrated magnetic assemblies; (b) lowered cost in manufacturing power efficient magnetic assemblies; and (c) reduced failure rates of integrated magnetic assemblies resulting from AC losses.

Exemplary embodiments of integrated magnetic assemblies and methods of assembling the same are described above in detail. The integrated magnetic assemblies and methods are not limited to the specific embodiments described herein but, rather, components of the integrated magnetic assemblies and/or operations of the methods may be utilized independently and separately from other components and/or operations described herein. Further, the described components and/or operations may also be defined in, or used in combination with, other systems, methods, and/or devices, and are not limited to practice with only the integrated magnetic assemblies and apparatuses described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. An integrated magnetic assembly comprising:

a magnetic core comprising:

a first component comprising a first face and a winding leg extending from the first face, the winding leg comprising a top face spaced from and oriented generally parallel to the first face;

a second component coupled to the first component, the second component comprising (i) a distal face facing the first face, (ii) a second face recessed from the distal face, (iii) a third face recessed from and oriented generally parallel to the second face, and (iv) a recess sidewall extending between the second face and the third face, wherein the third face and the recess sidewall define a recess within the second face, and wherein a gap is defined between the top face and the third face;

an input winding inductively coupled to the magnetic core, the input winding wound around the winding leg; and an output winding inductively coupled to the magnetic core, the output winding wound around the winding leg, wherein the input winding and the output winding define an outer winding perimeter, wherein a radial distance between a center point of the winding leg and the outer winding perimeter is less than the radial distance between a center point of the third face and the recess sidewall, wherein the first component and the second component are coupled and define a main magnetic flux path along which magnetic flux flows when the input winding is coupled to an electrical current, and wherein fringing flux at least in part due to the presence of the gap is induced to flow in a direction generally parallel to the input winding and the output winding.

2. The integrated magnetic assembly of claim 1, wherein the top face is located between the second face and the third face.

3. The integrated magnetic assembly of claim 1, wherein the second face is offset a first distance from the first face, wherein the top face is offset a second distance from the first face, and wherein the first distance is less than the second distance.

4. The integrated magnetic assembly of claim 1, wherein the recess sidewall is an annular sidewall.

5. The integrated magnetic assembly of claim 1, wherein the first component further comprises a first non-winding leg extending from the first face, the first non-winding leg comprising a first distal face spaced from and oriented generally parallel to the first face.

6. The integrated magnetic assembly of claim 5, wherein the first component further comprises a second non-winding leg extending from the first face towards the second face, the second non-winding leg comprising a second distal face coplanar with the first distal face.

7. The integrated magnetic assembly of claim 5, further comprising a non-winding leg sidewall extending between the first face and the first distal face, wherein the radial distance between the center point of the third face and the recess sidewall is less than a radial distance between a center point of the winding leg and the non-winding leg sidewall.

8. The integrated magnetic assembly of claim 1, wherein the magnetic core is ferrite.

9. A magnetic core for an integrated magnetic assembly, the magnetic core comprising:

a first component comprising a first face and a winding leg extending from the first face, the winding leg comprising a top face spaced from and oriented generally parallel to the first face; and a second component coupled to the first component, the second component comprising (i) a second face facing the first face, (ii) a third face recessed from and oriented generally parallel to the second face, and (iii) a recess sidewall extending between the second face and the third face;

wherein the third face and the recess sidewall define a recess within the second face; and wherein a gap is defined between the top face and the third face, wherein the first component and the second component are coupled and define a main magnetic flux path along which magnetic flux flows when an input winding coupled to the magnetic core is coupled to an electrical current, wherein fringing flux at least in part due to the presence of the gap is induced, the fringing flux flowing in a direction extending from a sidewall of the winding leg and generally perpendicular to the sidewall of the winding leg, and wherein an overlap region is defined wherein eddy current generated by the fringing flux overlaps and flows in opposite directions, thereby at least partially cancelling itself.

10. The magnetic core of claim 9, wherein the top face is positioned between the second face and the third face.

11. The magnetic core of claim 9, wherein the second face is offset a first distance from the first face, wherein the top face is offset a second distance from the first face, and wherein the first distance is less than the second distance.

12. The magnetic core of claim 9, wherein the recess sidewall is an annular sidewall.

13. The magnetic core of claim 9, further comprising a first non-winding leg extending from the first face, the first non-winding leg comprising a first distal face spaced from and oriented generally parallel to the first face.

14. The magnetic core of claim 13, further comprising a second non-winding leg extending from the first face, the second non-winding leg comprising a second distal face coplanar with the first distal face.

15. The magnetic core of claim 9 further comprising a second winding leg extending from the first face.

16. The magnetic core of claim 9, wherein the second component further comprises an additional third face that is coplanar with the third face.

17. A method of assembling an integrated magnetic assembly, the method comprising:

winding an input winding around a winding leg of a first component such that the input winding is inductively coupled to the first component, wherein the first component includes a first face, wherein the winding leg extends from the first face, and wherein the winding leg including a top face spaced from and oriented generally parallel to the first face;

winding an output winding around the winding leg of the first component such that the output winding is inductively coupled to the first component; and coupling a second component to the first component, the second component including (i) a second face, (ii) a third face recessed from and oriented generally parallel to the second face, and (iii) a recess sidewall extending between the second face and the third face, wherein the third face and the recess sidewall define a recess within the second face, wherein a gap is defined between the top face and the third face, wherein the first component and the second component are coupled and define a main magnetic flux path along which magnetic flux flows when the input winding is coupled to an electrical current, wherein fringing flux at least in part due to the presence of the gap is induced to flow in a direction generally parallel to the input winding and the output winding, wherein an overlap region is defined wherein eddy current generated by the fringing flux overlaps and flows in opposite directions, thereby at least partially canceling itself.

18. The method of claim 17, further comprising coupling a printed circuit board to the second component such that the printed circuit board is positioned between the first component and the second component and couples the first component to the second component.

19. The method of claim 17, wherein coupling the second component to the first component comprises positioning the top face between the second face and the third face.

* * * * *